US011384907B1

(12) United States Patent
Zou

(10) Patent No.: US 11,384,907 B1
(45) Date of Patent: Jul. 12, 2022

(54) STRING LIGHTS STRUCTURE

(71) Applicant: Xinjiang Zou, Meizhou (CN)

(72) Inventor: Xinjiang Zou, Meizhou (CN)

( * ) Notice: Subject to any disclaimer, the term of this patent is extended or adjusted under 35 U.S.C. 154(b) by 0 days.

(21) Appl. No.: 17/469,900

(22) Filed: Sep. 9, 2021

(30) Foreign Application Priority Data

Aug. 20, 2021 (CN) ..... 202121961777.6

(51) Int. Cl.

| | |
|---|---|
| ***F21S 4/10*** | (2016.01) |
| ***F21V 23/06*** | (2006.01) |
| ***F21V 17/08*** | (2006.01) |
| ***F21V 17/12*** | (2006.01) |
| ***F21V 21/002*** | (2006.01) |

(52) U.S. Cl.
CPC ..... *F21S 4/10* (2016.01); *F21V 17/08* (2013.01); *F21V 17/12* (2013.01); *F21V 21/002* (2013.01); *F21V 23/06* (2013.01)

(58) Field of Classification Search
CPC .. F21S 4/10; F21V 17/08; F21V 17/12; F21V 21/002; F21V 23/26
See application file for complete search history.

(56) References Cited

FOREIGN PATENT DOCUMENTS

| | | | | |
|---|---|---|---|---|
| AU | 2019100537 A4 * | 6/2019 | ..... | F21K 9/20 |
| CN | 113464853 A * | 10/2021 | | |
| DE | 202020107115 U1 * | 1/2021 | | |

* cited by examiner

*Primary Examiner* — Anabel Ton

(57) ABSTRACT

The present disclosure discloses a novel string lights structure, comprising a power cord, a male connector, and a female connector. The power cord is equipped with a plurality of light bulbs, and comprises a positive lead and a negative lead. The cap assembly comprises a cap inner core and a cap encapsulating part, and the cap inner core comprises an inner core body and an inner core top cover mounted at an upper end portion of the inner core body. The inner core body is internally opened with a body mounting hole, and is equipped with an anode connection terminal and a cathode connection terminal. An upper end portion of the light-emitting light source is embedded in the body mounting hole. The present disclosure has the advantages of novel design, convenient assembly, and good waterproof effect, and is conducive to realize the automated assembly.

8 Claims, 8 Drawing Sheets

STRING LIGHTS STRUCTURE

CROSS-REFERENCE TO RELATED APPLICATIONS

This is a U. S. patent application which claims the priority and benefit of Chinese Patent Application Number 202121961777.6, filed on Aug. 20, 2021, the disclosure of which is incorporated herein by reference in its entirety.

TECHNICAL FIELD

The present disclosure relates to the string lights, specifically relates to a novel string lights structure.

BACKGROUND

When Christmas comes, Christmas tree is used for decoration to heighten the festive atmosphere, which is already necessary for Christmas. The Christmas tree is often hung with decorations for decoration purpose, and the string lights has become a essential Christmas decoration.

For Christmas string lights, since they are often used outdoor, the requirement on the waterproof performance of the Christmas string lights is relatively high.

There are various string lights structures in the prior art. However, the existing string lights structures generally have shortcomings of poor waterproof performance and inconvenient assembly.

SUMMARY

Aiming to the shortcomings of the prior art, the present disclosure is to provide a novel string lights structure with novel design, convenient assembly, and good waterproof effect, which is conducive to realize the automated assembly.

To achieve the above objects, the following technical solution is employed by the present disclosure.

The novel string lights structure comprises a power cord, a male connector connected to a first end of the power cord, and a female connector connected to a second end of the power cord. The power cord is equipped with a plurality of light bulbs arranged at intervals along the power cord, and comprises a positive lead and a negative lead.

Each of the plurality of light bulbs comprises a cap assembly, a light-emitting light source, and a light-transmitting bulb. The light-emitting light source is provided with an anode terminal and a cathode terminal. The light-transmitting bulb is internally formed with a bulb inner cavity opening upwardly. The cap assembly comprises a cap inner core, and a cap encapsulating part formed at a periphery of the cap inner core by overmolding. The cap inner core comprises an inner core body, and an inner core top cover arranged at an upper end portion of the inner core body. The inner core body and the inner core top cover are made of rigid plastic parts. The power cord is tightly clamped between the inner core body and the inner core top cover. The inner core body is internally provided with a body mounting hole opening downwardly, and is provided with an anode connection terminal and a cathode connection terminal whose lower end portions extend into the body mounting hole, respectively. At upper end portions of the anode connection terminal and the cathode connection terminal are provided with a pointed penetration part protruding upwardly and in a spike shape, respectively. The pointed penetration part of the anode connection terminal penetrates a plastic sheath of the positive lead of the power cord, and is electrically connected to a core of the positive lead. The pointed penetration part of the cathode connection terminal penetrates a plastic sheath of the negative lead of the power cord, and is electrically connected to a core of the negative lead. An upper end portion of the light-emitting light source is embedded in the body mounting hole of the inner core body. The anode terminal of the light-emitting light source is electrically connected to the anode connection terminal, and the cathode terminal of the light-emitting light source is electrically connected to the cathode connection terminal. An upper end portion of the light-transmitting bulb is connected to a lower end portion of the cap encapsulating part, and a lower end portion of the light-emitting light source extends into the bulb inner cavity of the light-transmitting bulb.

A body wire-clamping slot opening upwardly and completely penetrating along an extension direction of the power cord is opened above the body mounting hole arranged at the upper end portion of inner core body. The body wire-clamping slot and the body mounting hole are arranged at intervals. The inner core top cover is provided with the top cover wire-clamping part protruding downwardly and inserting into the body wire-clamping slot of the inner core body. The top cover wire-clamping part and the inner core top cover are in an integrated structure. The power cord is tightly clamped between a bottom surface of the body wire-clamping slot and the top cover wire-clamping part.

A terminal mounting hole is opened on the bottom surface of the body wire-clamping slot, connecting to the body mounting hole and corresponding to the anode connection terminal and the cathode connection terminal, respectively. The anode connection terminal and the cathode connection terminal are embedded and clamped into the terminal mounting hole in a corresponding manner, respectively. The pointed penetration part of the anode connection terminal and the pointed penetration part of the cathode connection terminal extend into the body wire-clamping slot, respectively. The anode connection terminal and the cathode connection terminal comprise a terminal base, respectively. The terminal base of the anode connection terminal and the terminal base of the cathode connection terminal are embedded and clamped in the terminal mounting hole of the inner core body in a corresponding manner, respectively.

The pointed penetration part is provided at an upper end edge portion of the terminal base. At a lower end edge portion of the terminal base is provided with an elastic contact portion extending downwardly into the body mounting hole. The terminal base, the pointed penetration part, and the elastic contact portion of the anode connection terminal are in an integrated structure, and the terminal base, the pointed penetration part, and the elastic contact portion of the cathode connection terminal are in an integrated structure. The anode terminal of the light-emitting light source is in contact with the elastic contact part of the anode connection terminal, and the cathode terminal of the light-emitting light source is in contact with the elastic contact part of the cathode connection terminal.

The inner core top cover is provided with two top cover protrusions protruding downwardly, respectively. Each of the two top cover protrusions is integrated with the inner core top cover, respectively. The two top cover protrusions are spaced apart and arranged directly opposite to each other.

The inner core body is provided with two body recesses corresponding to the two top cover protrusions, respectively. The two top cover protrusions are buckled into the two body recesses in a corresponding manner, respectively.

On a lower surface of the top cover wire-clamping part is provided with a top cover limiting groove corresponding to the positive lead and the negative lead of the power cord, respectively.

At an upper end portion of the cap encapsulating part is provided with a fixing hook, and the fixing hook and the cap encapsulating part are in an integrated structure. The light-emitting light source is screwed into the body mounting hole.

The upper end portion of the light-transmitting bulb is screwed to the lower end portion of the cap encapsulating part.

The beneficial effects of the present disclosure are as follows: the novel string lights structure of the present disclosure comprises the power cord, the male connector connected to the first end of the power cord, and the female connector connected to the second end of the power cord. The power cord is equipped with the plurality of light bulbs arranged at intervals along the power cord, and comprises the positive lead and the negative lead. Each of the plurality of light bulbs comprises the cap assembly, the light-emitting light source, and the light-transmitting bulb. The light-emitting light source is provided with the anode terminal and the cathode terminal. The light-transmitting bulb is internally formed with the bulb inner cavity opening upwardly. The cap assembly comprises the cap inner core, and the cap encapsulating part formed at the periphery of the cap inner core by overmolding. The cap inner core comprises the inner core body, and the inner core top cover arranged at the upper end portion of the inner core body. The inner core body and the inner core top cover are made of rigid plastic parts. The power cord is tightly clamped between the inner core body and the inner core top cover. The inner core body is internally provided with the body mounting hole opening downwardly, and is provided with the anode connection terminal and the cathode connection terminal whose lower end portions extend into the body mounting hole, respectively. At the upper end portions of the anode connection terminal and the cathode connection terminal are provided with the pointed penetration part protruding upwardly and in a spike shape, respectively. The pointed penetration part of the anode connection terminal penetrates the plastic sheath of the positive lead of the power cord, and is electrically connected to the core of the positive lead. The pointed penetration part of the cathode connection terminal penetrates the plastic sheath of the negative lead of the power cord, and is electrically connected to the core of the negative lead. The upper end portion of the light-emitting light source is embedded in the body mounting hole of the inner core body. The anode terminal of the light-emitting light source is electrically connected to the anode connection terminal, and the cathode terminal of the light-emitting light source is electrically connected to the cathode connection terminal. The upper end portion of the light-transmitting bulb is connected to the lower end portion of the cap encapsulating part, and the lower end portion of the light-emitting light source extends into the bulb inner cavity of the light-transmitting bulb. Through the above structural design, the present disclosure has the advantages of novel design, convenient assembly, and good waterproof effect, and is conducive to realize the automated assembly.

BRIEF DESCRIPTION OF THE DRAWINGS

The following drawings are used to further illustrate the present disclosure, but the embodiments in the drawings do not limit the present disclosure in any way.

Figure 1:
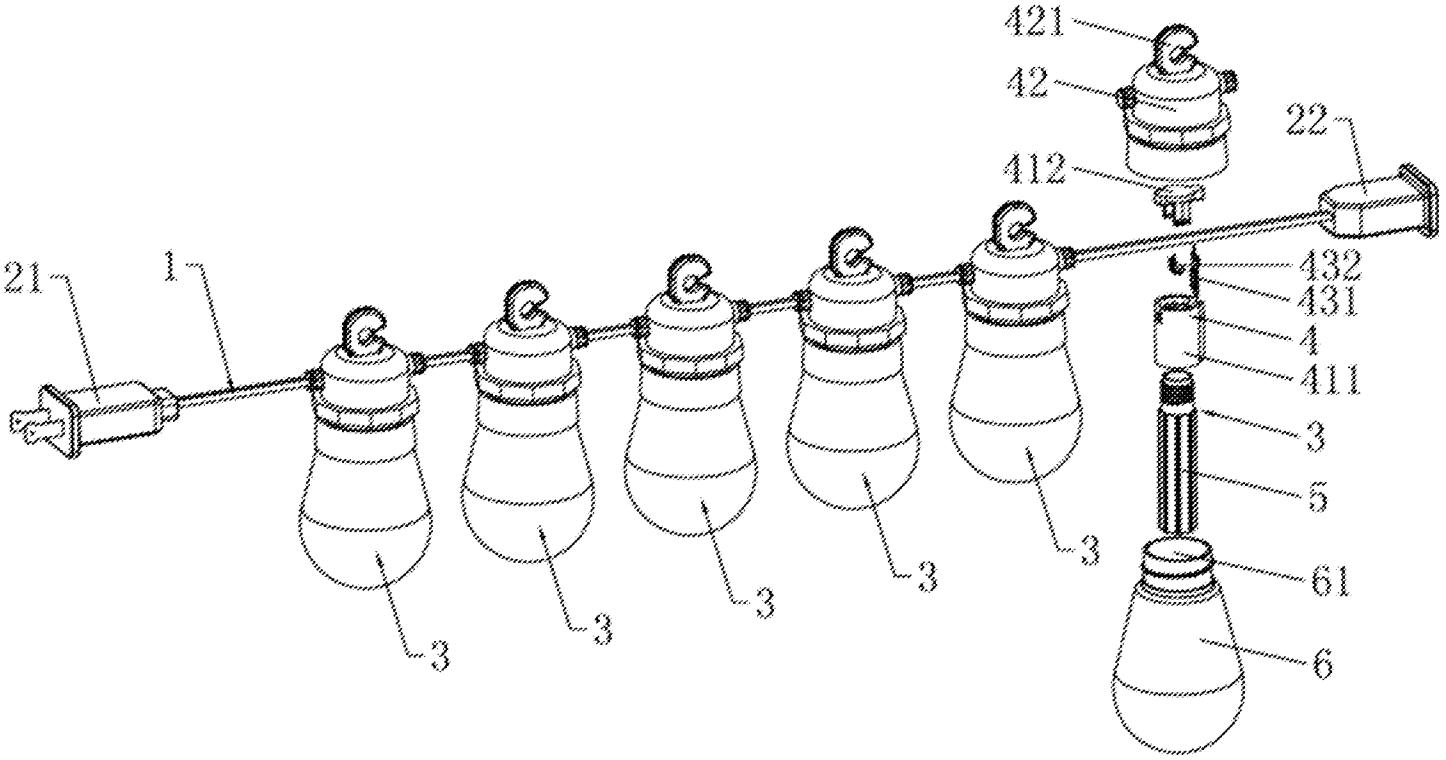
FIG. 1 is a schematic structural view of Embodiment 1.

It includes in FIG. 1 to FIG. 8:

| | |
|---|---|
| 1—power cord | 11—positive lead |
| 12—negative lead | 21—male connector |
| 22—female connector | 3—light bulb |
| 4—inner core body | 4111—body mounting hole |
| 4112—body wire-clamping slot | 4113—terminal mounting hole |
| 4114—body recess | 412—inner core top cover |
| 4121—top cover wire-clamping part | 4122—top cover protrusion |
| 4123—top cover limiting groove | 42—cap encapsulating part |
| 431—anode connection terminal | 432—cathode connection terminal |
| 433—point penetration part | 434—terminal base |
| 435 —elastic contact part | 5—light-emitting light source |
| 6—light-transmitting bulb | 61—bulb inner cavity |

DETAILED DESCRIPTION OF THE EMBODIMENTS

The present disclosure will be illustrated below in conjunction with specific embodiments.

As shown in FIG. 1, FIG. 6, FIG. 7 and FIG. 8, the novel string lights structure includes the power cord 1, the male connector 21 connected to the first end of the power cord 1, and the female connector 22 connected to the second end of the power cord 1. The power cord 1 is equipped with the plurality of light bulbs 3 arranged at intervals along the power cord 1, and includes the positive lead 11 and the negative lead 12.

As shown in FIGS. 1-8, each of the plurality of light bulbs 3 includes the cap assembly 4, the light-emitting light source 5, and the light-transmitting bulb 6. The light-emitting light source 5 is provided with the anode terminal and the cathode terminal. The light-transmitting bulb 6 is internally formed with the bulb inner cavity 61 opening upwardly. The cap assembly 4 includes the cap inner core 41, and the cap encapsulating part 42 formed at the periphery of the cap inner core 41 by overmolding. The cap inner core 41 includes the inner core body 411, and the inner core top cover 412 arranged at the upper end portion of the inner core body 411. The inner core body 411 and the inner core top cover 412 are made of rigid plastic parts. The power cord 1 is tightly clamped between the inner core body 411 and the inner core top cover 412. The inner core body 411 is internally provided with a body mounting hole 4111 opening downwardly. The inner core body 411 is provided with the anode connection terminal 431 and the cathode connection terminal 432 whose lower end portions extend into the body mounting hole 4111, respectively. At the upper end portions of the anode connection terminal 431 and the cathode connection terminal 432 are provided with the pointed penetration part 433 protruding upwardly and in a spike shape, respectively. The pointed penetration part 433 of the anode connection terminal 431 penetrates the plastic sheath of the positive lead 11 of the power cord 1, and is electrically connected to the core of the positive lead 11. The pointed penetration part 433 of the cathode connection terminal 432 penetrates the plastic sheath of the negative lead 12 of the power cord 1, and is electrically connected to the core of the negative lead 12. The upper end portion of the light-emitting light source 5 is embedded in the body mounting hole 4111 of the inner core body 411. The anode terminal of the light-emitting light source 5 is electrically connected to the anode connection terminal 431, and the cathode terminal of the light-emitting light source 5 is electrically connected to the cathode connection terminal 432. The upper end portion of the light-transmitting bulb 6 is connected to the lower end portion of the cap encapsulating part 42, and the lower end portion of the light-emitting light source 5 extends into the bulb inner cavity 61 of the light-transmitting bulb 6. Preferably, the light-emitting light source 5 is screwed into the body mounting hole 4111, and the upper end portion of the light-transmitting bulb 6 is screwed to the lower end portion of the cap encapsulating part 42. The above-mentioned screwing method is obviously not to limit the present disclosure.

Further, the body wire-clamping slot 4112 opening upwardly and completely penetrating along the extension direction of the power cord 1 is opened above the body mounting hole 4111 arranged at the upper end portion of inner core body 411. The body wire-clamping slot 4112 and the body mounting hole 4111 are arranged at intervals. The inner core top cover 412 is provided with the top cover wire-clamping part 4121 protruding downwardly and inserting into the body wire-clamping slot 4112 of the inner core body 411, and the top cover wire-clamping part 4121 and the inner core top cover 412 are in an integrated structure. The power cord 1 is tightly clamped between the bottom surface of the body wire-clamping slot 4112 and the top cover wire-clamping part 4121. The bottom surface of the body wire-clamping slot 4112 is provided with the terminal mounting hole 4113 connecting to the body mounting hole 4111 and corresponding to the anode connection terminal 431 and the cathode connection terminal 432, respectively. The anode connection terminal 431 and the cathode connection terminal 432 are embedded and clamped into the terminal mounting hole 4113 in a corresponding manner, respectively. The pointed penetration part 433 of the anode connection terminal 431 and the pointed penetration part 433 of the cathode connection terminal 432 extend into the body wire-clamping slot 4112, respectively.

Figure 2:
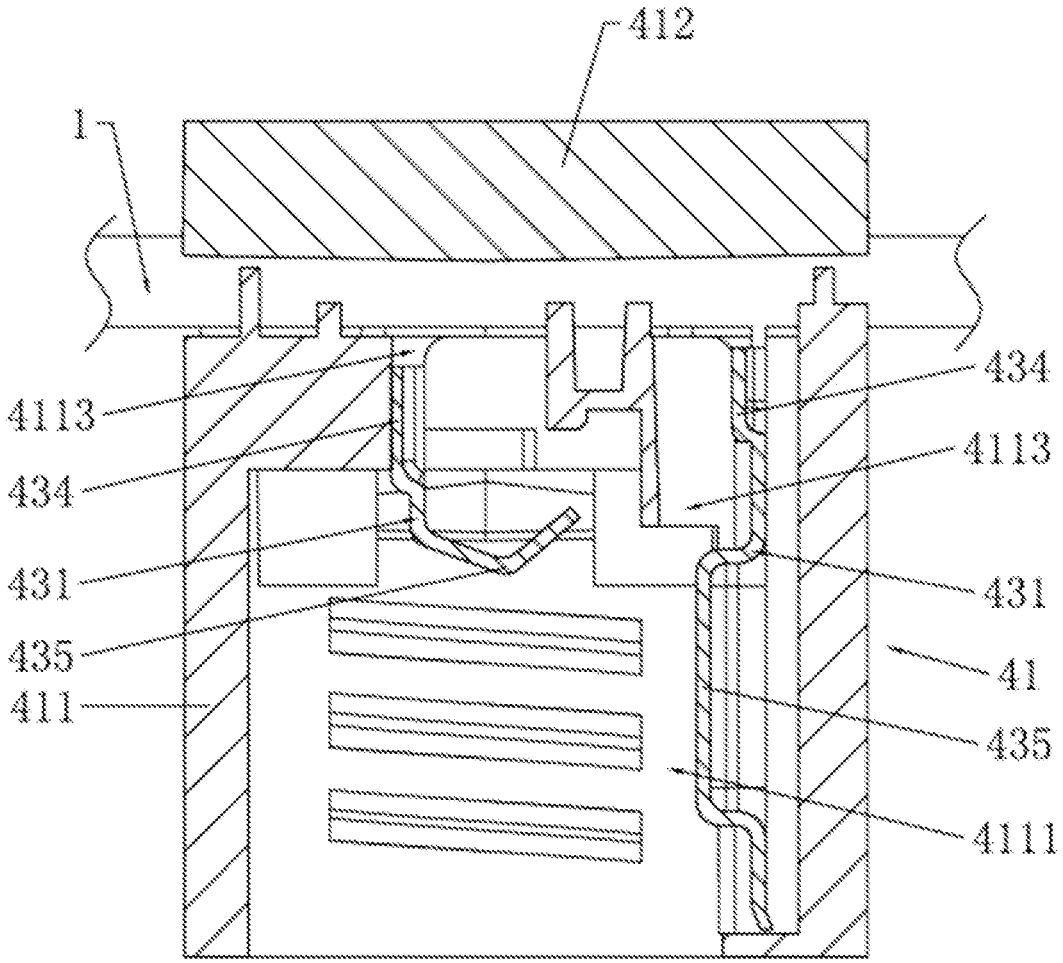
FIG. 2 is a schematic cross-sectional view of a cap inner core of Embodiment 1.
Figure 4:
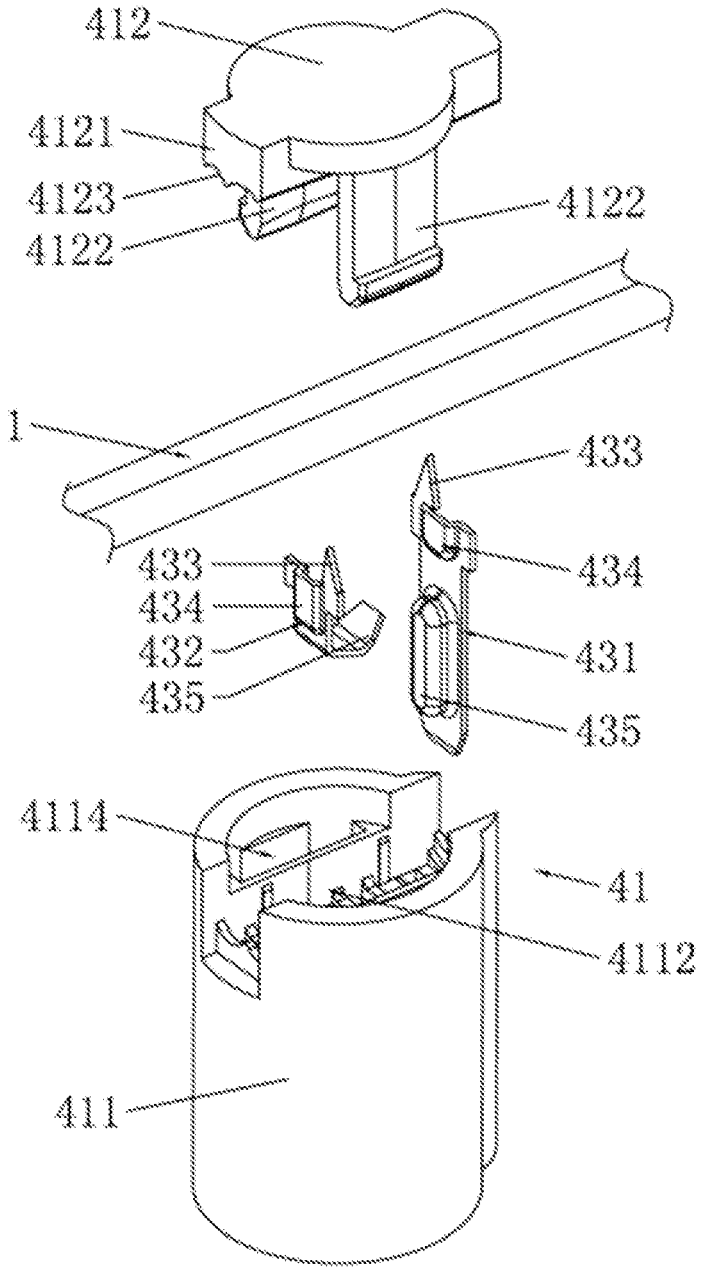
FIG. 4 is an exploded view of the cap inner core of Embodiment 1.
Figure 5:
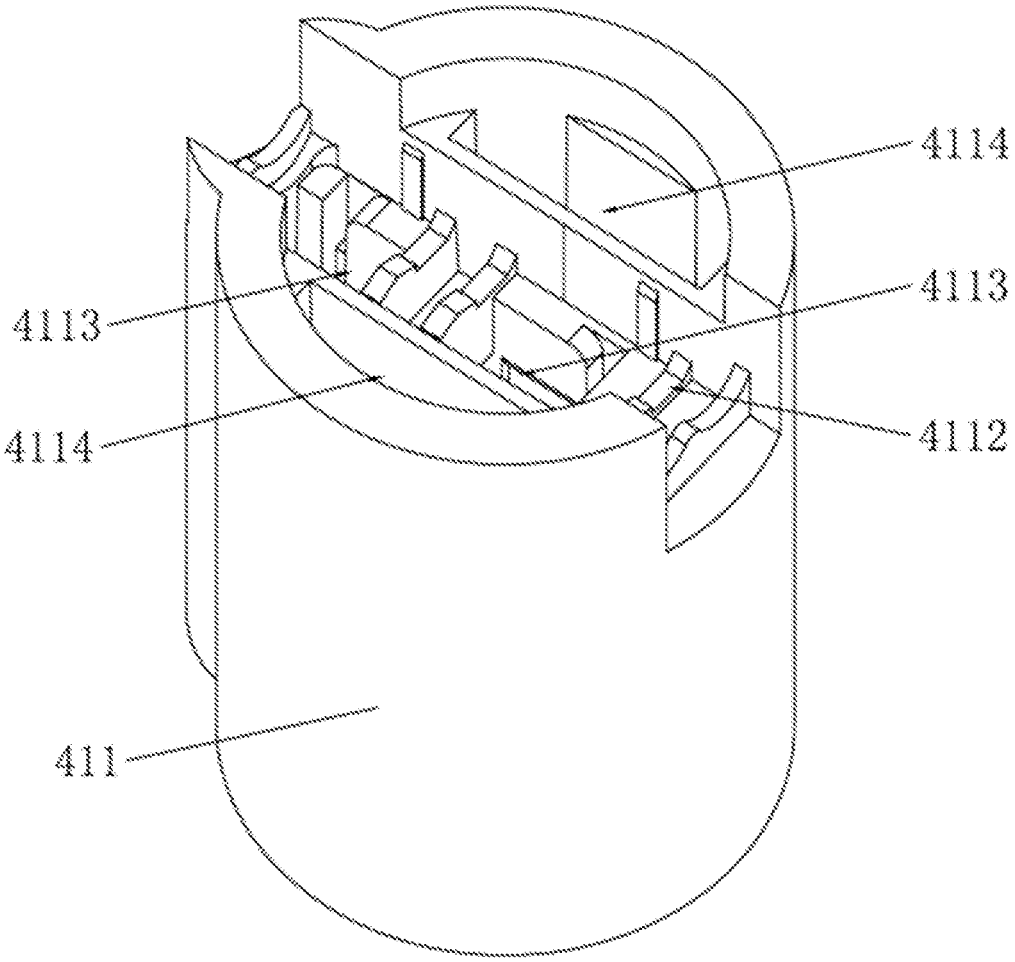
FIG. 5 is a schematic structural view of an inner core body of Embodiment 1.
Figure 6:
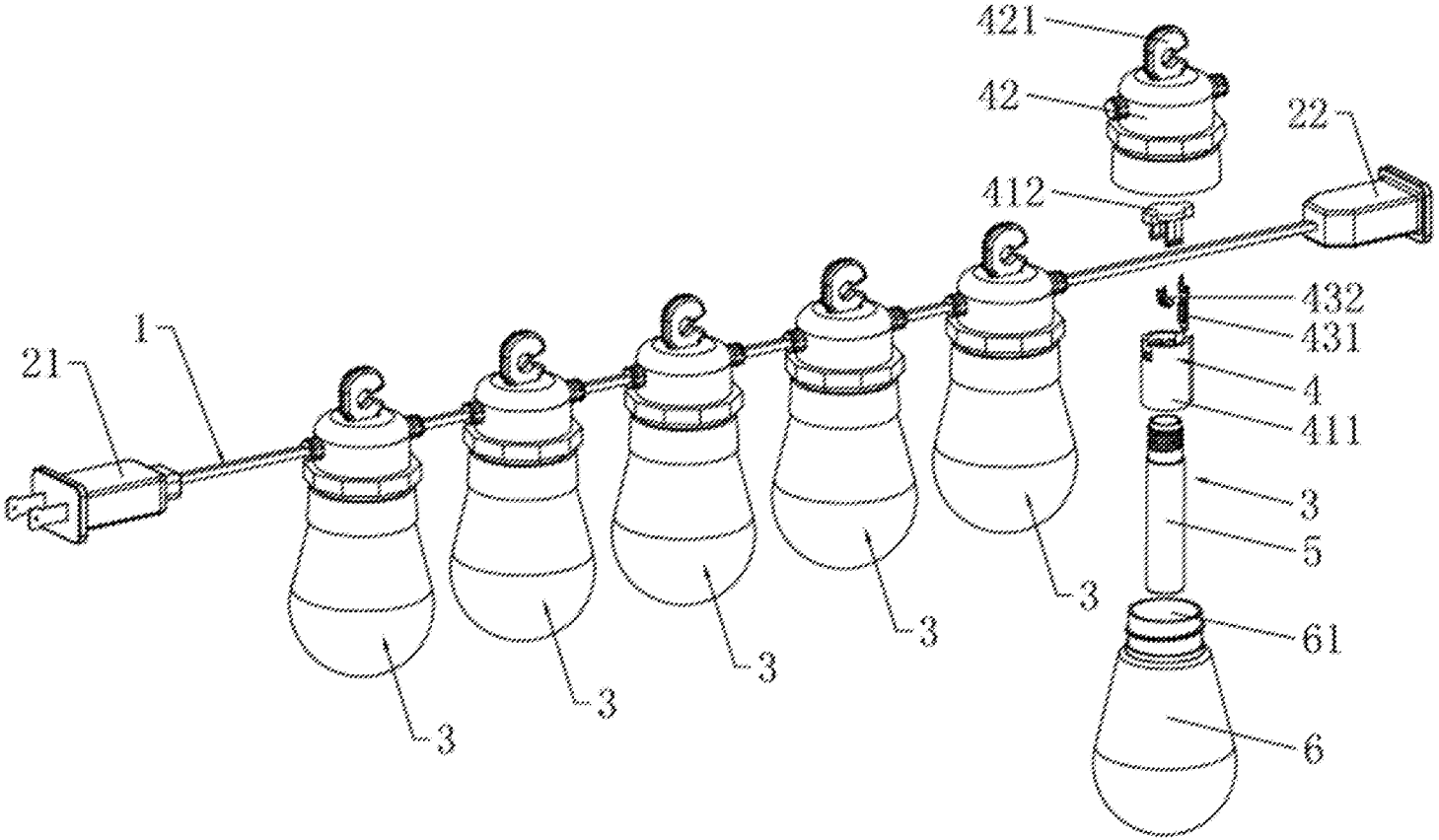
FIG. 6 is a schematic structural view of Embodiment 2.
Figure 7:
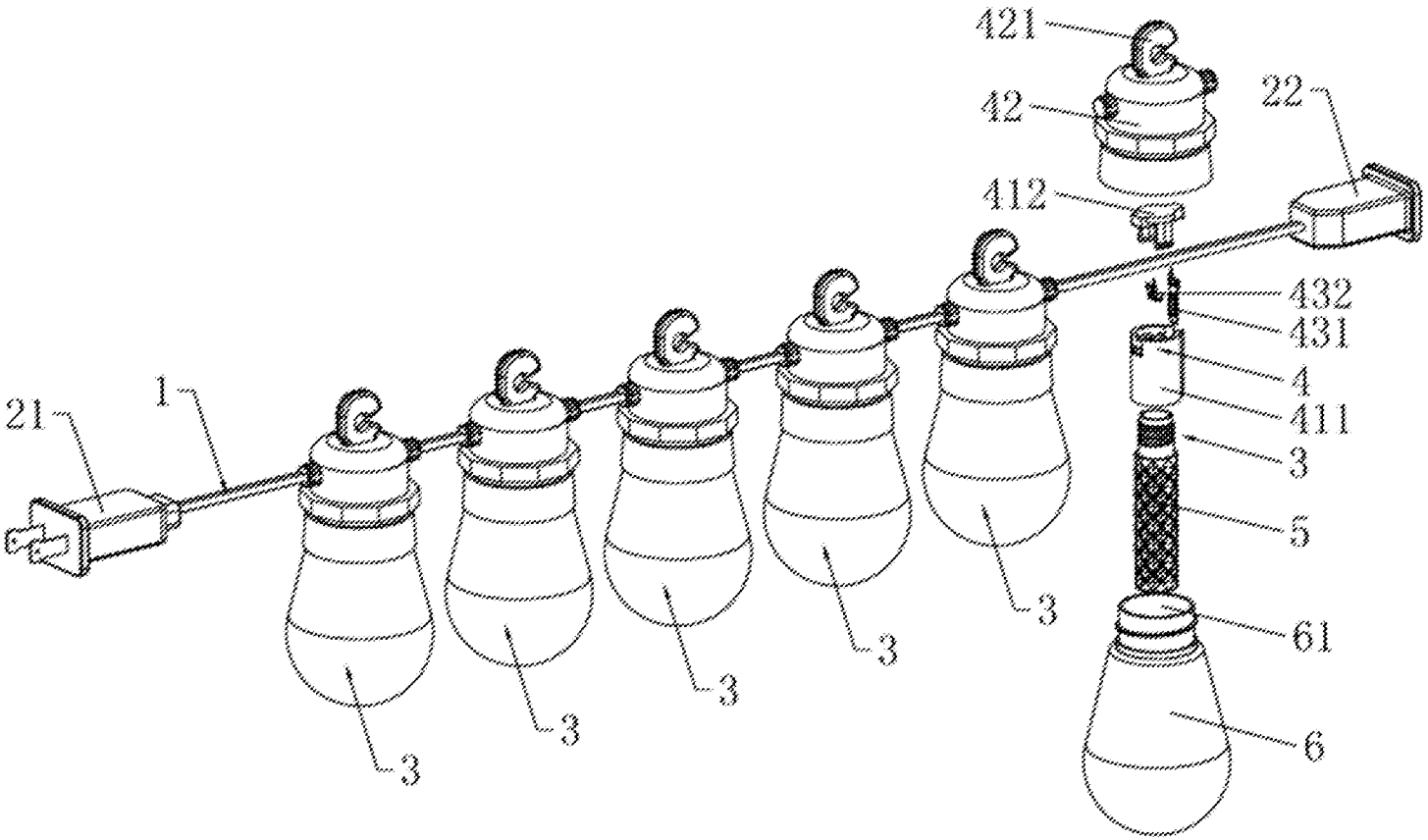
FIG. 7 is a schematic structural view of Embodiment 3.
Figure 8:
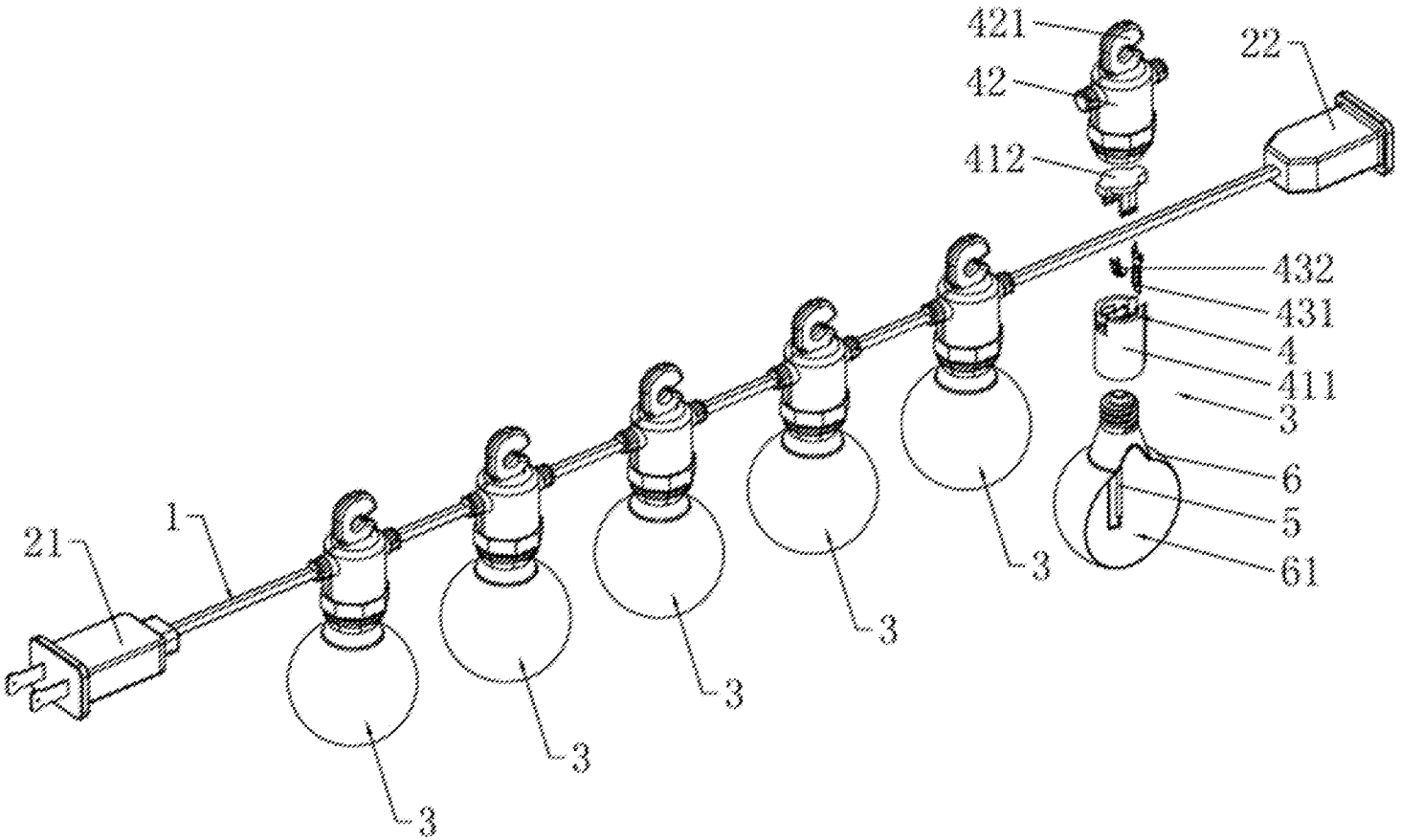
FIG. 8 is a schematic structural view of Embodiment 4.

As shown in FIG. 2 and FIG. 4, the anode connection terminal 431 and the cathode connection terminal 432 includes the terminal base 434, respectively. The terminal base 434 of the anode connection terminal 431 and the terminal base 434 of the cathode connection terminal 432 are embedded and clamped in the terminal mounting hole 4113 of the inner core body 411 in a corresponding manner, respectively. The pointed penetration part 433 is provided at the upper end edge portion of the terminal base 434. At the lower end edge portion of the terminal base 434 is provided with the elastic contact portion 435 extending downwardly into the body mounting hole 4111. The terminal base 434, the pointed penetration part 433, and the elastic contact portion 435 of the anode connection terminal 431 are in an integrated structure, and the terminal base 434, the pointed penetration part 433, and the elastic contact portion 435 of the cathode connection terminal 432 are in an integrated structure. The anode terminal of the light-emitting light source 5 is in contact with the elastic contact part 435 of the anode connection terminal 431, and the cathode terminal of the light-emitting light source 5 is in contact with the elastic contact part 435 of the cathode connection terminal 432.

For the inner core top cover 412 of the present disclosure, it is arranged at the upper end portion of the inner core body 411 by fastening. Specifically, the inner core top cover 412 is provided with the two top cover protrusions 4122 protruding downwardly, respectively. Each of the two top cover protrusions 4122 is integrated with the inner core top cover 412, respectively. The two top cover protrusions 4122 are spaced apart and arranged directly opposite to each other. The inner core body 411 is provided with the two body recesses 4114 corresponding to the two top cover protrusions 4122, respectively. The two top cover protrusions 4122 are buckled into the two body recesses 4114 in a corresponding manner, respectively.

For assembling the plurality of light bulbs 3 of the present disclosure, the anode connection terminal 431 and the cathode connection terminal 432 are firstly embedded and clamped into the terminal mounting hole 4113 of the inner core body 411 in a corresponding manner, respectively. Then, the positive lead 11 and the negative lead 12 of the power cord 1 is put into the body wire-clamping slot 4112 of the inner core body 411. After the power cord 1 is put into the body wire-clamping slot 4112 of the inner core body 411, the inner core top cover 412 is buckled to the upper end portion of the inner core body 411. The top cover wire-clamping part 4121 of the inner core top cover 412 presses the positive lead 11 and the negative lead 12 of the power cord 1, so that the pointed penetration part 433 of the anode connection terminal 431 penetrates the plastic sheath of the positive lead 11, and is electrically connected to the core of the positive lead 11, and the pointed penetration part 433 of the cathode connection terminal 432 penetrates the plastic sheath of the negative lead 12, and is electrically connected to the core of the negative lead 12. After mounting the inner core top cover 412, the cap encapsulating part 42 is formed by overmolding. Since the cap encapsulating part 42 coats the upper end portion of the cap inner core 41, the cap encapsulating part 42 is capable of effectively improving the waterproof effect of the cap inner core 41.

In addition, the assembly of the cap assembly 4 of the present disclosure is convenient, and conducive to realize the automated assembly.

Figure 3:
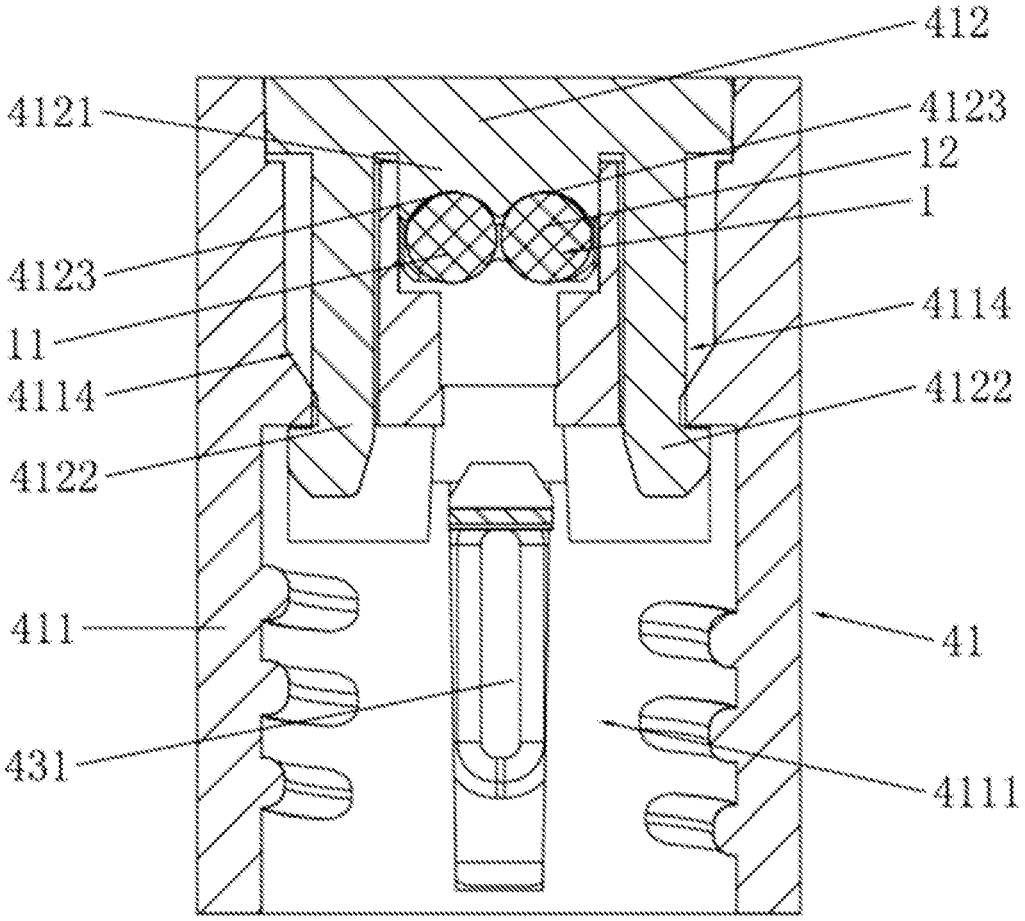
FIG. 3 is a schematic cross-sectional view of another position of the cap inner core of Embodiment 1.

As the preferred embodiments, shown in FIG. 3 and FIG. 4, the top cover limiting groove 4123 is provided on the lower surface of the top cover wire-clamping part 4121, corresponding to the positive lead 11 and the negative lead 12 of the power cord 1, respectively. When the power cord 1 is pressed tightly by the top cover wire-clamping part 4121, the positive lead 11 and the negative lead 12 of the power cord 1 are limited by the top cover limiting groove 4123 in a corresponding manner, respectively. In the process that the power cord 1 is pressed tightly by the top cover wire-clamping part 4121 of the inner core top cover 412, the present disclosure can realize the limitation of the power cord 1 through the top cover limiting groove 4123, to improve the stability of pressing the positive lead 11 and the negative lead 12. As the preferred embodiments, shown in FIG. 1, FIG. 6, FIG. 7 and FIG. 8, to facilitate the mounting of the plurality of light bulbs 3, the present disclosure adopts the structural design specifically as follows: the fixing hook 421 is provided at the upper end portion of the cap encapsulating part 42, and the fixing hook 421 and the cap encapsulating part 42 are in an integrated structure.

The above embodiments are only the preferred embodiments of the present disclosure. For those ordinarily skilled in the art, changes in the specific implementation and the scope of application can be made according to the ideas of the present disclosure. It shall be understood that the content of the description is not to limit the present disclosure.

What is claimed is:

1. A novel string lights structure, wherein, comprising a power cord, a male connector connected to a first end of the power cord, and a female connector connected to a second end of the power cord; wherein, the power cord is equipped with a plurality of light bulbs arranged at intervals along the power cord; and the power cord comprises a positive lead and a negative lead;

each of the plurality of light bulbs comprises a cap assembly, a light-emitting light source, and a light-transmitting bulb; the light-emitting light source is provided with an anode terminal and a cathode terminal; the light-transmitting bulb is internally formed with a bulb inner cavity opening upwardly; the cap assembly comprises a cap inner core, and a cap encapsulating part formed at a periphery of the cap inner core by overmolding; and the cap inner core comprises an inner core body, and an inner core top cover arranged at an upper end portion of the inner core body; the inner core body and the inner core top cover are made of rigid plastic parts; the power cord is tightly clamped between the inner core body and the inner core top cover; the inner core body is internally opened with a body mounting hole opening downwardly; the inner core body is provided with an anode connection terminal and a cathode connection terminal whose lower end portions extend into the body mounting hole, respectively; at upper end portions of the anode connection terminal and the cathode connection terminal are provided with a pointed penetration part protruding upwardly and in a spike shape, respectively; the pointed penetration part of the anode connection terminal penetrates a plastic sheath of the positive lead of the power cord, and is electrically connected to a core of the positive lead; and the pointed penetration part of the cathode connection terminal penetrates a plastic sheath of the negative lead of the power cord, and is electrically connected to a core of the negative lead; an upper end portion of the light-emitting light source is embedded in the body mounting hole of the inner core body, and the anode terminal of the light-emitting light source is electrically connected to the anode connection terminal, and the cathode terminal of the light-emitting light source is electrically connected to the cathode connection terminal; an upper end portion of the light-transmitting bulb is connected to a lower end portion of the cap encapsulating part, and a lower end portion of the light-emitting light source-extends into the bulb inner cavity of the light-transmitting bulb.

2. The novel string lights structure according to claim 1, wherein, a body wire-clamping slot opening upwardly and completely penetrating along an extension direction of the power cord is opened above the body mounting hole arranged at the upper end portion of inner core body; the body wire-clamping slot and the body mounting hole are arranged at intervals; the inner core top cover is provided with a top cover wire-clamping part protruding downwardly and inserting into the body wire-clamping slot of the inner core body, and the top cover wire-clamping part and the inner core top cover are in an integrated structure; and the power cord is tightly clamped between a bottom surface of the body wire-clamping slot and the top cover wire-clamping part;

a terminal mounting hole is opened on the bottom surface of the body wire-clamping slot, connecting to the body mounting hole and corresponding to the anode connection terminal and the cathode connection terminal, respectively; the anode connection terminal and the cathode connection terminal are embedded and clamped into the terminal mounting hole in a corresponding manner, respectively; and the pointed penetration part of the anode connection terminal and the pointed penetration part of the cathode connection terminal extend into the body wire-clamping slot, respectively.

3. The novel string lights structure according to claim 2, wherein, the anode connection terminal and the cathode connection terminal comprise a terminal base, respectively; the terminal base of the anode connection terminal and the terminal base of the cathode connection terminal are embedded and clamped in the terminal mounting hole of the inner core body in a corresponding manner, respectively;

the pointed penetration part is provided at an upper end edge portion of the terminal base; at a lower end edge portion of the terminal base is provided with an elastic contact portion extending downwardly into the body mounting hole; the terminal base-, the pointed penetration part, and the elastic contact portion of the anode connection terminal are in an integrated structure; the terminal base, the pointed penetration part-, and the elastic contact portion of the cathode connection terminal are in an integrated structure; the anode terminal of the light-emitting light source is in contact with the elastic contact part of the anode connection terminal, and the cathode terminal of the light-emitting light source is in contact with the elastic contact part of the cathode connection terminal.

4. The novel string lights structure according to claim 2, wherein, the inner core top cover is provided with two top cover protrusions protruding downwardly, respectively; and each of the two top cover protrusions is integrated with the inner core top cover, respectively; the two top cover protrusions are spaced apart and arranged directly opposite to each other;

the inner core body is provided with two body recesses corresponding to the two top cover protrusions, respectively; and the two top cover protrusions are buckled into the two body recesses in a corresponding manner, respectively.

5. The novel string lights structure according to claim 2, wherein, a top cover limiting groove is provided on a lower surface of the top cover wire-clamping part, corresponding to the positive lead and the negative lead of the power cord, respectively.

6. The novel string lights structure according to claim 1, wherein, at an upper end portion of the cap encapsulating part is provided with a fixing hook; and the fixing hook and the cap encapsulating part are in an integrated structure.

7. The novel string lights structure according to claim 1, wherein, the light-emitting light source is screwed into the body mounting hole.

8. The novel string lights structure according to claim 1, wherein, the upper end portion of the light-transmitting bulb is screwed to the lower end portion of the cap encapsulating part.

* * * * *